US007417184B2

(12) United States Patent
Weathersby

(10) Patent No.: US 7,417,184 B2
(45) Date of Patent: Aug. 26, 2008

(54) PORTABLE GUITAR PICK HOLDER APPARATUS

(76) Inventor: Sherri D. Weathersby, 10043 S. Rhodes, Chicago, IL (US) 60628

( * ) Notice: Subject to any disclaimer, the term of this patent is extended or adjusted under 35 U.S.C. 154(b) by 0 days.

(21) Appl. No.: 11/191,200

(22) Filed: Jul. 27, 2005

(65) Prior Publication Data

US 2006/0096440 A1 May 11, 2006

Related U.S. Application Data

(60) Provisional application No. 60/591,534, filed on Jul. 27, 2004.

(51) Int. Cl.
*G10D 3/16* (2006.01)

(52) U.S. Cl. ..... 84/322; 17/20

(58) Field of Classification Search ..... 84/320–322, 84/329; D17/20; D3/226
See application file for complete search history.

(56) References Cited

U.S. PATENT DOCUMENTS 4,135,431 A 1/1979 Ferguson
4,785,708 A * 11/1988 Vaughan ..... 84/329
4,890,531 A 1/1990 Tischer
5,231,238 A * 7/1993 Adams ..... 84/329
D355,667 S 2/1995 Burger
5,488,892 A 2/1996 Jepsen
5,651,468 A 7/1997 Irizarry
D393,362 S 4/1998 Byers
5,905,217 A * 5/1999 Byers ..... 84/322
6,215,052 B1 * 4/2001 Giddens et al. ..... 84/329
6,472,590 B1 10/2002 Kulik

* cited by examiner

*Primary Examiner*—Renee S Luebke
*Assistant Examiner*—Vanessa Girardi
(74) *Attorney, Agent, or Firm*—Lesavich High-Tech Law Group, P.C.; Stephen Lesavich

(57) ABSTRACT

A portable guitar pick holder apparatus. The portable guitar pick holder apparatus includes a receptacle means that includes plural guitar pick storage openings contained therein for storing plural guitar picks. The plural guitar pick storage openings include a manual pick removal means and an automatic pick removal means. The pocket may further include plural guitar pick openings on the exterior of the front or back of the pocket. The portable guitar pick holder apparatus is selectively attachable to and removable from a human guitar player, a guitar strap or other objects to provide a readily and quickly available, organized supply of guitar picks.

16 Claims, 3 Drawing Sheets

FIG. 1
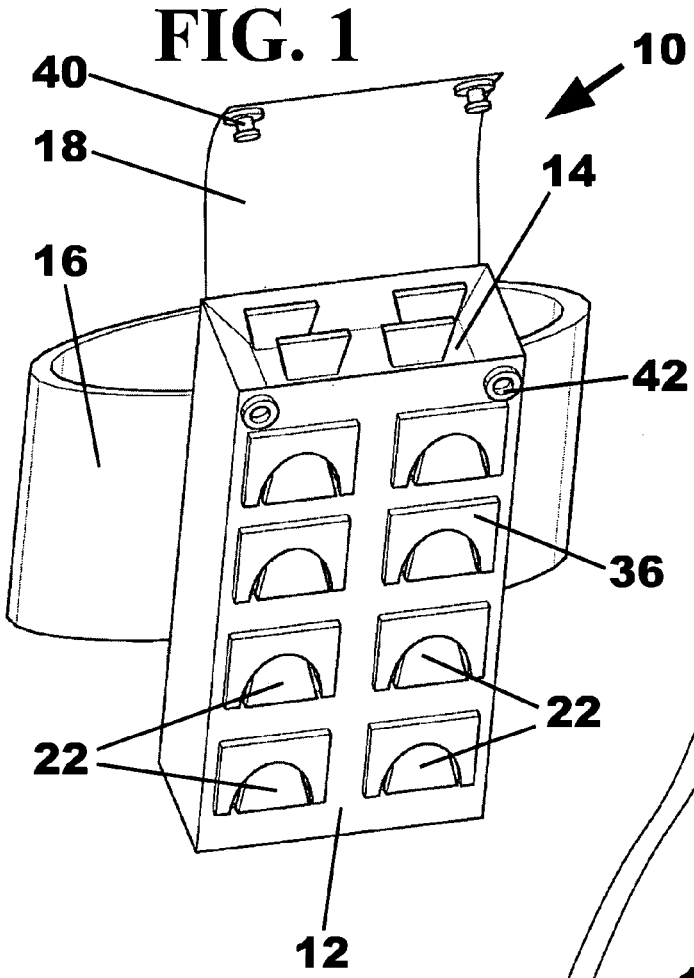
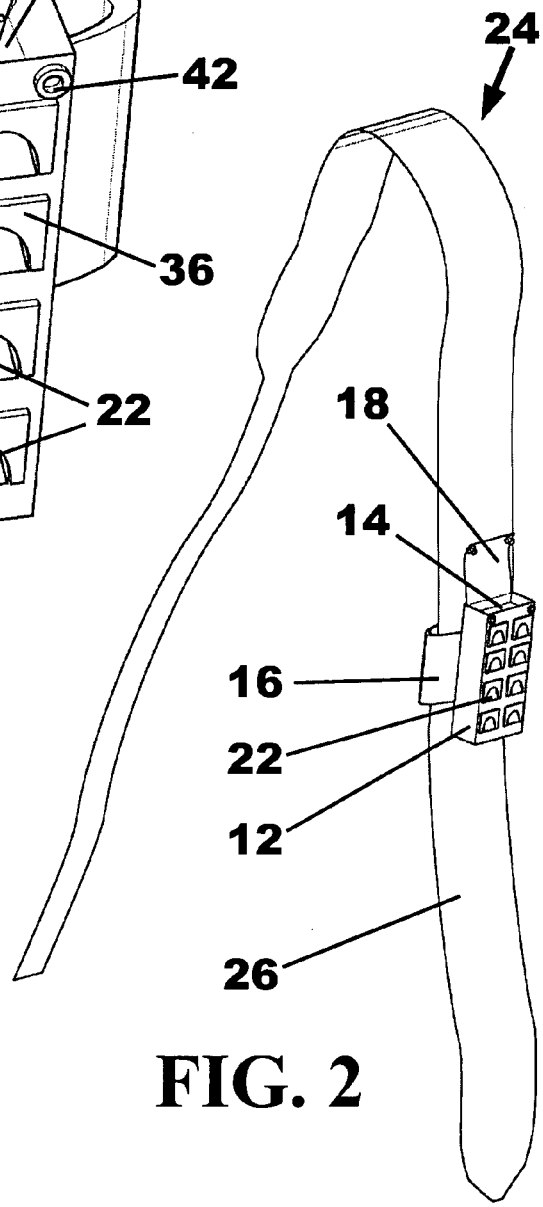
FIG. 2

PORTABLE GUITAR PICK HOLDER APPARATUS

CROSS REFERENCES TO RELATED APPLICATIONS

This application claims priority from U.S. Provisional Application 60/591,534, filed Aug. 27, 2004, the contents of which are incorporated by reference.

FIELD OF THE INVENTION

This invention relates to a pick holder for string instruments. More specifically, it relates to a pick holder apparatus.

BACKGROUND OF THE INVENTION

There are many types of music that can be composed and played on string instruments. There is classical music, rock-n-roll, hip-hop and other types of music that are played on string instruments.

One popular type of string instrument is the guitar. Most guitar player uses guitar picks to play music on the guitar. There are several problems associated with using guitar picks to play music on the guitar. One problem is that guitar players typically use many different picks during a musical performance. The guitar player may drop, break or otherwise desire to select a certain pick to play a song. It is desirable to have a supply of picks readily available during musical performance.

Another problem is that a guitar player typically desires to store his/her picks with the guitar. The picks are often placed in a guitar case or other container. The picks are often lost or become unorganized in the guitar case or other container.

Another problem is that a guitar player typically has one or more favorite picks that he/she would like to organize and display when the guitar is not being played.

Another problem is that guitar pick holders often lack aesthetic appeal, shake loose from their holders and/or require permanent mounting to a guitar.

There have been attempts to solve some of these problems. For example, U.S. Pat. No. 4,135,431 that issued to Ferguson teaches a stringed musical pick or plectrum dispenser for receiving, retaining, and dispensing a pick, the dispenser being mounted in fixed relation to an instrument sound board adjacent the instrument strings. Each pick is wafer thin and generally triangular in shape. The dispenser may be mounted on a pick guard which has a first edge alignable with the instrument string that is last plucked to guard against, and prevent, continued downward travel of the pick thus protecting the finish on the instrument sound board. A dispenser housing has a perimetral wall with upper and lower edges. The housing defines in cross-section the general configuration of a pick. A bottom side is affixed to the lower wall edge and a top side is affixed to the upper wall edge. A pick receiving and dispensative opening is formed in the top side. The opening receives a pick and provides an inner surface for engaging and retaining the pick in the dispenser while exposing a pick surface through the opening. Resilient means are mounted in the housing for exerting a uniform resilient force against the pick urging it towards the retaining surface. The housing is mounted to the pick guard adjacent a second guard edge opposite the first edge with the dispensative opening being more distant from the first edge than the retaining surface so that the dispensative direction of the pick is away from the first edge.

For example, U.S. Pat. No. 4,785,708 that issued to Vaughan teaches a pick holder for a guitar is mounted in a cradle portion of a side wall of a guitar and contains a strip having a plurality of pick-receiving pockets. The pick holder has a first fastening portion affixed to the guitar body and a second fastening portion containing the pick-receiving pockets. The two fastening portions enable the strip of pick-receiving pockets to be detachably fastened to the guitar body.

U.S. Pat. No. 4,890,531 that issued to Tischer teaches a holder for stringed instrument picks is provided in which picks may be temporarily stored by inserting them between adjacent pairs of parallel vanes, which are resiliently displaced to retain the pick. In one embodiment, the vanes may be formed by the coils of a helical spring, and the holder may be attached to the face of a musical instrument or to another convenient flat or curved surface. For more secure or longer term storage, a pick may be inserted in compression between the spring and an underlying pad. A rod may be passed through the spring coils to prevent distortion and movement of the spring.

U.S. Pat. No. D355,667 that issued to Burger teaches an ornamental design for a guitar pick holder.

Thus, it is desirable to provide a portable pick holder for guitars and other musical instruments.

SUMMARY OF THE INVENTION

In accordance with preferred embodiments of the present invention, some of the problems associated with guitar pick holders are overcome. A portable guitar pick holder apparatus is presented.

The portable guitar pick holder apparatus includes a receptacle means that includes plural guitar pick storage openings contained therein for storing plural guitar picks. In one embodiment, the plural guitar pick storage openings include a manual pick removal means and an automatic pick removal means. The receptacle means may further include plural guitar pick openings on the exterior of the front or back of the pocket.

The portable guitar pick holder apparatus is selectively attachable to and removable from a human guitar player, a guitar strap or other objects to provide a readily and quickly available, organized supply of guitar picks.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein:

FIG. 2 is a block diagram of a portable guitar pick holder apparatus attached to a guitar strap;

DETAILED DESCRIPTION OF THE INVENTION

Figure 3:
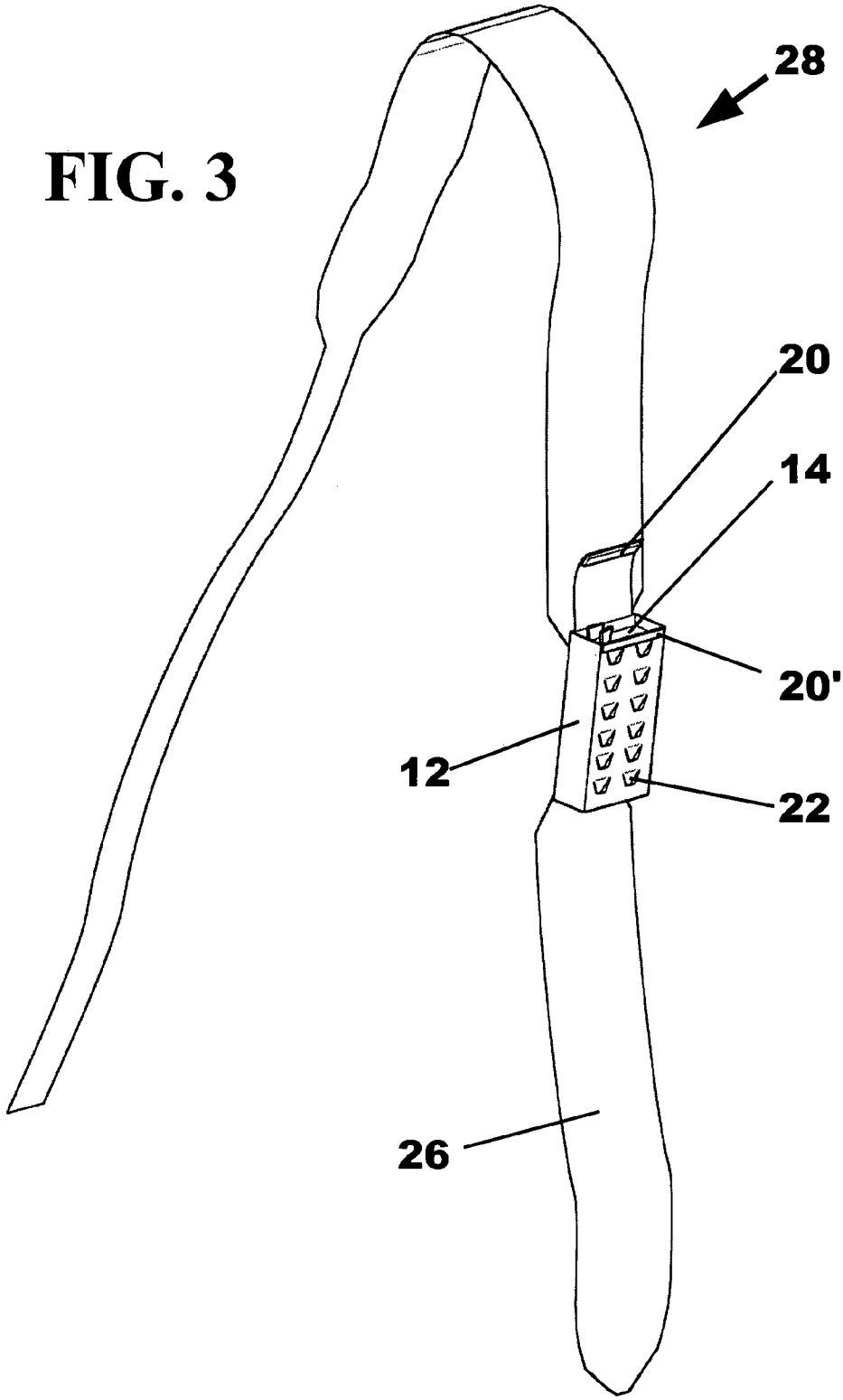
FIG. 3 is a block diagram of a portable guitar pick holder apparatus integral to a guitar strap.

FIG. 1 is a block diagram of a portable guitar pick holder apparatus 10. The portable guitar pick apparatus includes a receptacle means 12 including a front side, a back side, a left side, a right side and a bottom side. A first side of the back side of the receptacle means 12 includes a first set of plural storage openings 14 inside the receptacle means 12 for storing plural guitar picks. The portable guitar pick holder apparatus 10 further includes a mounting means 16 for attaching the portable guitar pick holder apparatus 10 to a human guitar player, or a guitar (e.g., on the back of a guitar neck, etc.). The mounting means 16 includes, but is not limited to, a strap, band or a Velcro™ or other fabric hook and loop means, or other types of mounting means.

In one embodiment, the receptacle means 12 includes, but is not limited to, a cloth, leather, plastic, fur, or canvas material. However, the present invention is not limited to these materials and or other type of materials can also be used for the receptacle means 12.

In one embodiment, the mounting means 16 is attached directly to the receptacle means 12. In another embodiment, the mounting means 16 is attached to a loop attached to a backside of the receptacle means 12.

In one embodiment, the portable guitar pick apparatus 10 further comprises a cover means 18 attached to the second side of the back side of the receptacle means 12 and to the front side of the receptacle means 12 to cover the receptacle means 12.

In one embodiment of the invention, the cover means 18 includes a Velcro™ hook or other fabric hook 20 on the cover means 18 and a Velcro™ or other fabric loop fastener 20' (FIG. 3) on the receptacle means 12. In another embodiment of the invention, the cover means 18 includes a two-piece fastener including a first fastening piece 40 on the receptacle means 12 and a second fastening piece 42 on the cover means 18.

In such an embodiment, the two-piece fastener 40, 42 (FIG. 1) includes metal or plastic snaps or nobs or other types of fasteners. In another embodiment of the invention, the cover means 18 includes a fastener on the receptacle means 12 and a hole in the cover means 18 for capturing the fastener. For example, the fastener includes a bottom, metal or plastic nob, or other type of fastener (not illustrated).

In one embodiment, the portable guitar pick apparatus of claim 1 further comprises a second set of plural storage openings 22 on the front side of the receptacle 12 for storing plural guitar picks.

Figure 4:
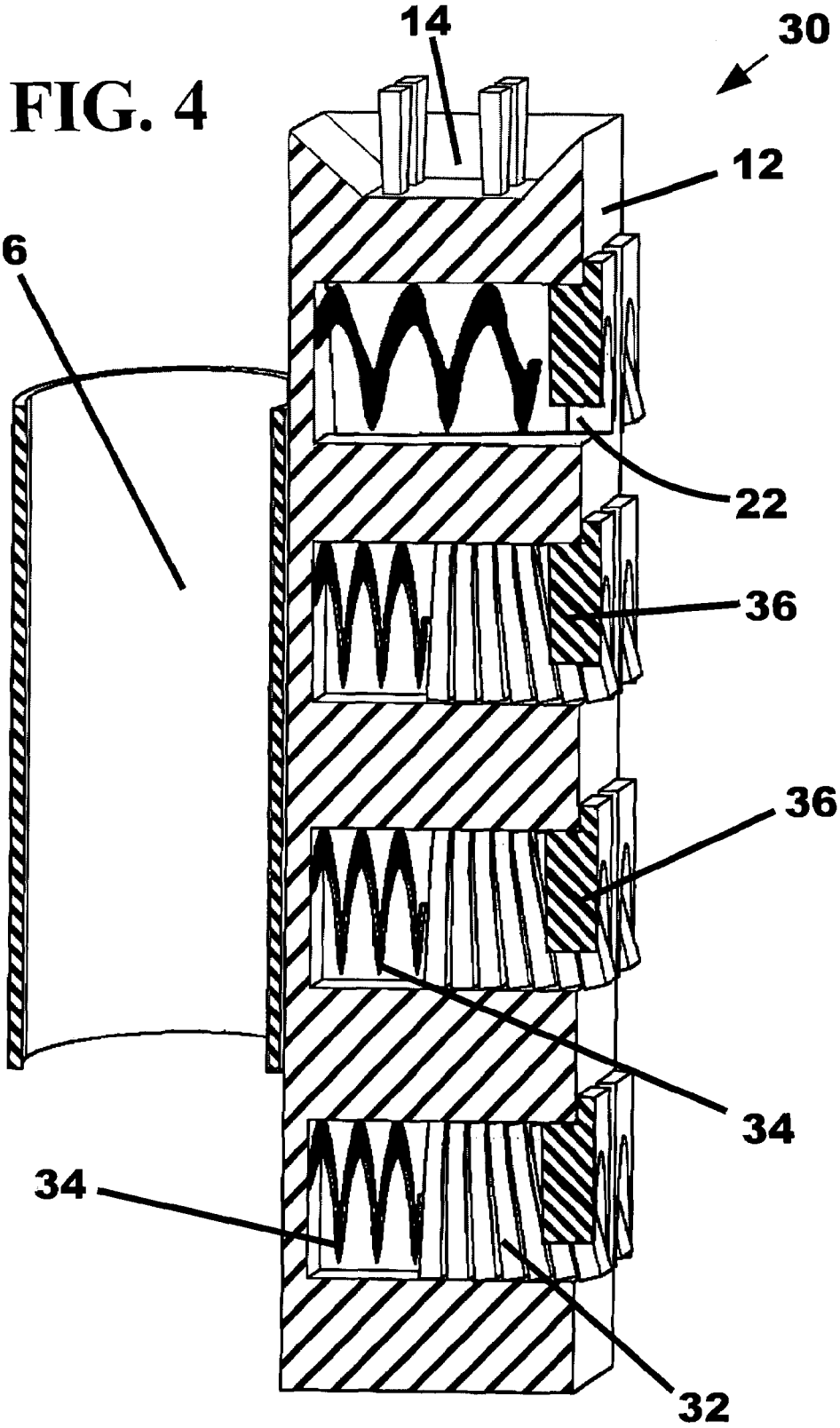
FIG. 4 is a block diagram of cross section of a portable guitar pick holder apparatus.

FIG. 4 is a block diagram cross section of a portable guitar pick holder apparatus 30. In one embodiment, the second set of a plural storage openings 22 include an automatic pick removal means wherein the automatic pick removal means automatically ejects one or more picks 32 when activated. In one embodiment, the automatic pick removal means includes plural springs 34 with plural release switches 36 for selectively ejecting a guitar pick when a release switch is activated. In such an embodiment, the first set of plural storage openings 14 include a manual pick removal means.

In another embodiment, the portable guitar pick holder apparatus 10 includes a pocket 12. The pocket includes a pocket cover 18 for closing the pocket 12. In another embodiment, the pocket 12 is open and does not include a pocket cover 18. The pocket 12 includes a first set of plural guitar pick storage openings 14 contained therein for storing plural guitar picks. The pocket 12 may further include a second set of plural guitar pick openings 22 on the exterior of the front or back of the pocket 12. The plural first set and second set of guitar pick storage openings 14, 22 are specifically sized and shaped to hold guitar picks.

In one embodiment, the pocket 12 includes, but is not limited to, a cloth, leather, plastic, fur, or canvas material. However, the present invention is not limited to these materials and or other type of materials can also be used for the pocket 12.

In one embodiment, the portable guitar pick holder apparatus 10 is attachable to a guitar strap. In such an embodiment, the portable guitar pick holder apparatus 10 is selectively attachable and removable.

In another embodiment, the portable guitar pick holder apparatus 10 is attachable to a portion of a human guitar player, such as a wrist, arm, leg, etc. or clothing thereon such as a belt, etc. The portable guitar pick holder apparatus 10 allows the human guitar player access to a supply of guitar picks. In such an embodiment, the portable guitar pick holder apparatus 10 is selectively attachable and removable.

In another embodiment, the portable guitar pick holder apparatus 10 is attached to a guitar strap. In such an embodiment, the portable guitar pick holder apparatus 10 is selectively attachable and removable.

FIG. 2 is a block diagram 24 of a portable guitar pick holder apparatus 10 attached to a guitar strap 26 with the attachment means 16.

In another embodiment, the portable guitar pick holder apparatus 10 is integral to a guitar strap. In such an embodiment, the portable guitar pick holder apparatus 10 is not selectively attachable and removable.

FIG. 3 is a block diagram 28 of a portable guitar pick holder apparatus 10 integral to a guitar strap 26. No attachment means 16 is used. In such an embodiment, the portable guitar pick holder apparatus 10 is not removable from the guitar strap 26.

In another embodiment, the portable guitar pick holder apparatus 10 is integral to a guitar strap 26 and includes only a front portion of the pocket 12 with a second set of plural guitar pick storage openings 22 contained therein.

In another embodiment, the portable guitar pick holder apparatus 10 includes only a front portion of the pocket 12 with a first set plural guitar pick storage openings 14 contained therein and selectively attachable to and removable from a neck of a guitar or other portion of a guitar without interfering with playing motions used to play the guitar.

The portable guitar pick holder apparatus 10 provides a readily and quickly available, organized supply of guitar picks. The portable guitar pick holder apparatus 10 has been described with respect to guitars. However, the present invention is not limited to such an embodiment and portable guitar pick holder apparatus 10 can also be used on other musical instruments with strings.

It should be understood that the programs, processes, methods and system described herein are not related or limited to any particular type components unless indicated otherwise. Various combinations of general purpose, specialized or equivalent components may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or equivalent elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A portable guitar pick apparatus, comprising in combination:

a receptacle means including a front side, a back side, a left side, a right side and a bottom side;

a first set of a plurality of storage openings on a first side of the back side of the receptacle means and inside the receptacle means for storing a first set of plurality guitar picks, wherein the first set of the plurality of storage openings includes an automatic pick removal means wherein the automatic pick removal means automatically ejects one or more picks when activated;

a second set of a plurality of storage openings on the front side of the receptacle means for storing a second set of plurality of guitar picks, wherein the second set of plurality of storage openings include a manual pick removal means; and a mounting means for attaching the portable guitar pick holder apparatus to a human guitar player, or a guitar.

2. The portable guitar pick apparatus of claim 1 further comprising a cover means attached to the second side of the back side of the receptacle means and to the front side of the receptacle means to cover an opening the receptacle means.

3. The portable guitar pick apparatus of claim 1 further comprising a fabric hook on the cover means and a fabric loop fastener on the receptacle means for attaching the cover means to the receptacle means.

4. The portable guitar pick apparatus of claim 1 wherein the receptacle means includes a cloth, leather, plastic, fur, or canvas material.

5. The portable guitar pick apparatus of claim 1 wherein the mounting means includes a strap, band or fabric hook and fabric loop fastener.

6. The portable guitar pick holder apparatus of claim 1 wherein the receptacle means is integral to a guitar strap and is not removable from the guitar strap.

7. The portable guitar pick holder apparatus of claim 1 wherein the receptacle means selectively attachable and removable to a guitar strap.

8. The portable guitar pick apparatus of claim 1 wherein the cover means includes a two-piece fastener including a first fastening piece on the receptacle means and a second fastening piece on the cover means.

9. The portable guitar pick apparatus of claim 8 wherein the two-piece fastener includes metal or plastic snaps or nobs.

10. The portable guitar pick holder apparatus for claim 1 wherein the automatic pick removal means automatically ejects one or more guitar picks for the first set of the plurality of storage openings when activated.

11. The portable guitar pick holder apparatus for claim 10 wherein the automatic pick removal means includes a plurality of springs with a plurality of release switches for selectively ejecting a guitar pick when a release switch is activated.

12. A portable guitar pick apparatus, comprising in combination:

a pocket including a front side, a back side, a left side, a right side and a bottom side;

a first set of a plurality of storage openings on a first side of the back side of the pocket and inside the pocket for storing a first set of plurality guitar picks, wherein the first set of a plurality of storage openings includes a manual pick removal component;

a second set of a plurality of storage openings on the front side of the pocket for storing a second set of plurality of guitar picks, wherein the second set of a plurality of storage openings includes an automatic pick removal component wherein the automatic pick removal component automatically ejects one or more picks when activated;

a cover attached to the second side of the back side of the pocket and to the front side of the pocket to cover the pocket; and a mounting portion for attaching the portable guitar pick holder apparatus to a human guitar player, or a guitar.

13. The portable guitar pick apparatus of claim 12 wherein the pocket includes a cloth, leather, plastic, fur, or canvas material.

14. The portable guitar pick apparatus of claim 13 wherein the mounting portion includes a strap, band or fabric hook and fabric loop fastener.

15. The portable guitar pick holder apparatus of claim 13 wherein pocket is integral to a guitar strap and is not removable from the guitar strap.

16. The portable guitar pick holder apparatus of claim 13 wherein the pocket is selectively attachable and removable to a guitar strap.

* * * * *